US005933867A

United States Patent [19]

Corder

[11] Patent Number: 5,933,867

[45] Date of Patent: Aug. 10, 1999

[54] PROMOTIONAL ITEM HAVING DECORATIVE EMBLEM AND METHOD OF MAKING SAME

[75] Inventor: Donald E. Corder, Gahanna, Ohio

[73] Assignee: The Auld Company, Columbus, Ohio

[21] Appl. No.: 08/855,978

[22] Filed: May 14, 1997

Related U.S. Application Data

[60] Provisional application No. 60/018,799, May 31, 1996.

[51] Int. Cl.[6] ..... A41D 19/00

[52] U.S. Cl. ..... 2/160; 428/14; 428/99; 428/100; 40/630

[58] Field of Search ..... 428/99, 14, 100; 2/160; 40/630

[56] References Cited

U.S. PATENT DOCUMENTS

| | | | |
|---|---|---|---|
| 3,965,488 | 6/1976 | Paulucci | 2/160 |
| 4,100,010 | 7/1978 | Waugh | 156/242 |
| 4,292,827 | 10/1981 | Waugh | 72/46 |
| 4,332,074 | 6/1982 | Auld et al. | 29/527.4 |
| 4,356,617 | 11/1982 | Coscia | 29/527.4 |
| 4,481,160 | 11/1984 | Bree | 264/135 |
| 4,556,588 | 12/1985 | Rockwood | 428/13 |
| 4,605,575 | 8/1986 | Auld et al. | 428/14 |
| 4,643,790 | 2/1987 | Waugh et al. | 156/242 |
| 4,801,479 | 1/1989 | Fielder et al. | 428/31 |
| 4,852,276 | 8/1989 | Savoca et al. | 40/636 |

*Primary Examiner*—Alexander Thomas
*Attorney, Agent, or Firm*—Killworth, Gottman, Hagan & Schaeff, L.L.P.

[57] ABSTRACT

The present invention is directed to a promotional item, such as a golf glove, having a decorative emblem. The promotional item comprises a promotional item, a mount and a decorative emblem. The mount has a recessed portion formed therein and is attached to the promotional item. The decorative emblem has a rear surface coated with an adhesive. The rear surface of the decorative emblem is placed in the recessed portion of the mount and is attached to the mount by the adhesive. The invention is also directed to a method for making such a promotional item.

7 Claims, 3 Drawing Sheets

PROMOTIONAL ITEM HAVING DECORATIVE EMBLEM AND METHOD OF MAKING SAME

This application claims the benefit of U.S. provisional application Ser. No. 60/018,799 filed May 31, 1996 and entitled "Golf Glove Having Logo and Method of Making the Same."

BACKGROUND OF THE INVENTION

The present invention relates to promotional items and, more particularly, to promotional items bearing decorative emblems. Commonly, clubs, resorts, companies and other organizations attach their custom designed emblems or logos to various promotional items, such as hats, gloves, jackets, other clothing items and novelty items, as a form of advertisement and promotion. Often, the emblems or logos are embroidered onto the item. The process of embroidering emblems onto promotional items is both time consuming and expensive. Once the embroidered emblems are sewn onto the promotional item, they are difficult, if not impossible, to remove without damaging the promotional item. Another problem with embroidered emblems is that they are often difficult to see. Further, conventional embroidered emblems do not hold up well after exposure to water.

For these reasons, a need exists in the art for a promotional item having a decorative emblem which can be easily attached to the promotional item. A need also exists for a decorative emblem which is durable and capable of withstanding harsh weather conditions, when the promotional item is exposed to such conditions. Finally, a need also exists in the art for making such a promotional item.

SUMMARY OF THE INVENTION

The invention accomplishes the objectives set forth above by providing a promotional item bearing a decorative emblem, which is coated with a durable material to protect the emblem from damage while in use. Further, the present invention provides an easier and simpler method for making such a promotional item.

One aspect of the present invention is directed to a method for attaching a decorative emblem to a promotional item. In one step, a decorative emblem is provided. In another step, a rear surface of the decorative emblem is coated with an adhesive. In another step, a mount having a recessed portion therein is provided. In still another step, a promotional item is provided. Next, the mount is attached to the promotional item. In another step, the rear surface of the decorative emblem is placed in the recessed portion of the mount so that the adhesive secures the decorative emblem in the mount.

Another aspect of the present invention is directed to a promotional item having a decorative emblem. The promotional item comprises a promotional item, a mount and a decorative emblem. The mount has a recessed portion formed therein and is attached to the promotional item. The decorative emblem has a rear surface coated with an adhesive. The rear surface of the decorative emblem is placed in the recessed portion of the mount and is attached to the mount by the adhesive.

Still another aspect of the present invention is directed to a glove. The glove comprises a mount and a decorative emblem. The mount has a recessed portion formed therein. The decorative emblem includes an emblem coated with a polyurethane coating. The decorative emblem has a rear surface coated with an adhesive. The rear surface of the decorative emblem is placed in the recessed portion of the mount and is attached to the mount by the adhesive.

Accordingly, it is an object of the present invention to provide an easier and less expensive method of attaching an emblem to a promotional item. It is another object of the present invention to provide an emblem for a promotional item which is more visible than embroidered emblems. It is a still further object of the invention to provide for promotional items an emblem which is more durable than conventional embroidered emblems, and able to withstand harsh weather conditions. These, and other objects and advantages of the present invention, will become apparent from the drawings and the following detailed description and accompanying claims.

DETAILED DESCRIPTION OF THE PREFERRED EMBODIMENTS

Figure 1:
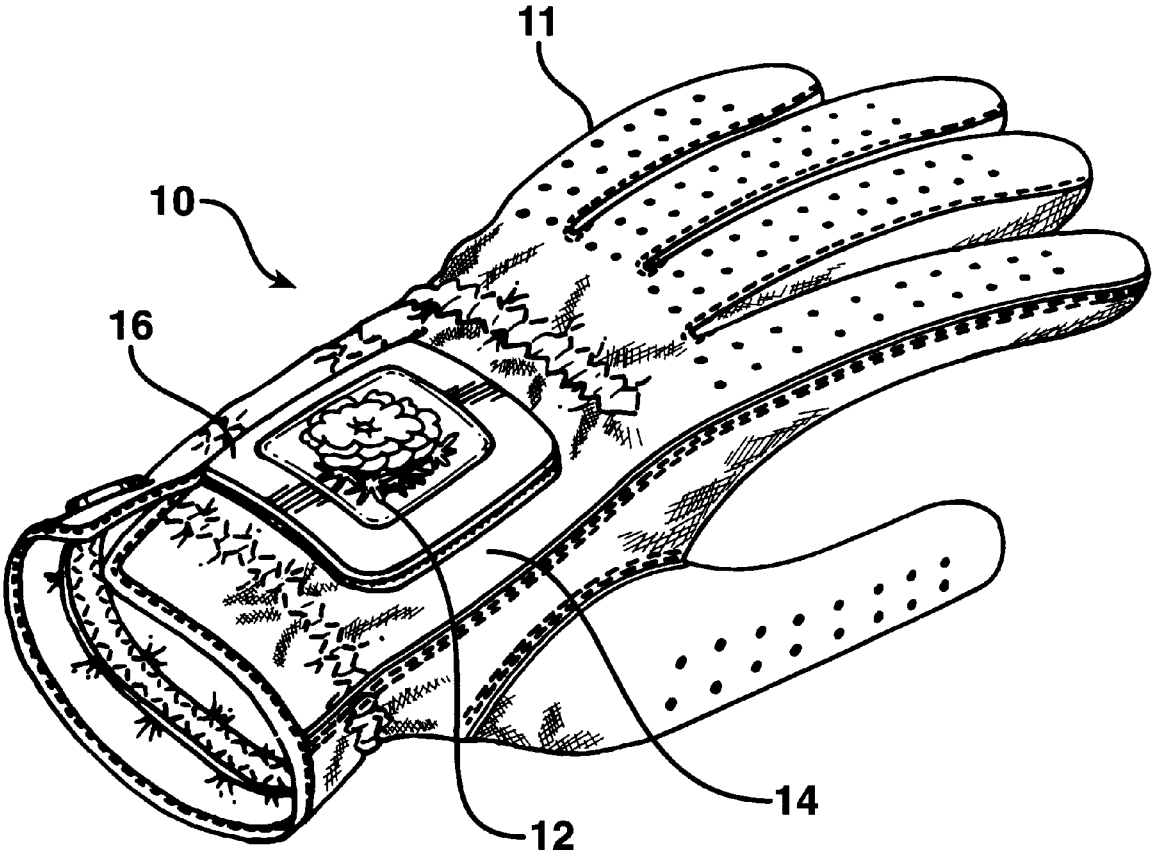
FIG. 1 shows a perspective of a promotional item of this invention.

A promotional item 10 of the present invention is shown in FIG. 1. As shown in FIG. 1, the promotional item 10 is a golf glove 11. The promotional item 10 includes a decorative emblem 12 mounted thereon. The decorative emblem 12 is positioned on a surface 14 of the promotional item 10 in a mount 16. As can be seen in the exploded view shown in FIG. 4, the mount 16 has a recessed portion 17 formed therein. The decorative emblem 12 is releasably secured in the recessed portion 17 by an adhesive material. The mount 16 can be permanently or removably attached to the promotional item 10. The mount 16 can be attached to the promotional item 10 in any manner currently used in the art. For example, mount 16 can be attached to the surface 14 of promotional item 10 by means of a hook and loop fastener, gluing, snaps, stitching or stapling.

Figure 2:
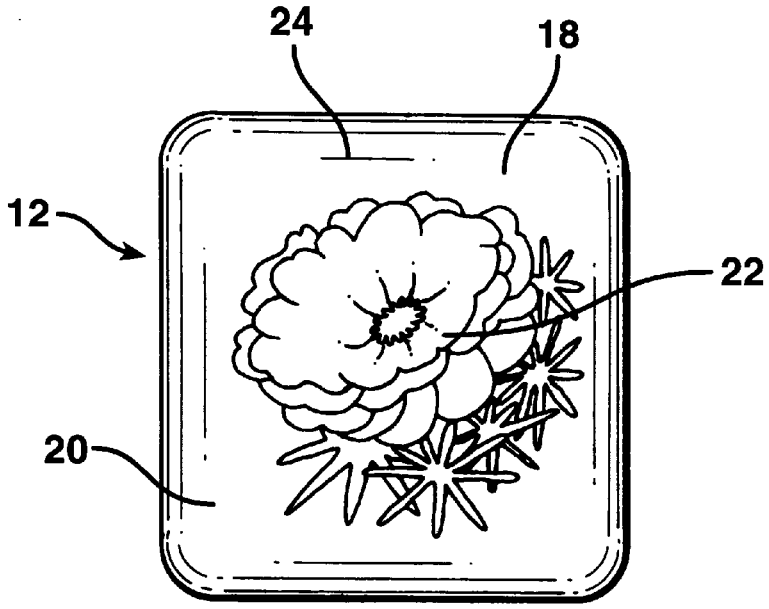
FIG. 2 shows a front plan view of the decorative emblem.

A front view of the decorative emblem 12 is shown in FIG. 2. The decorative emblem 12 includes a substrate 18 having a front surface 20, an emblem 22 and a coating 24. The emblem 22 is desirably printed onto the substrate 18. The emblem 22 is coated with a coating 24. The coating 24 protects the emblem 22 so that if the decorative emblem 12 becomes wetted, the emblem 22 will not be damaged or if the coating 24 is scratched, the emblem 22 will not be scratched. The coating 24 further serves as a lens to make the emblem 22 more visible.

Figure 3:
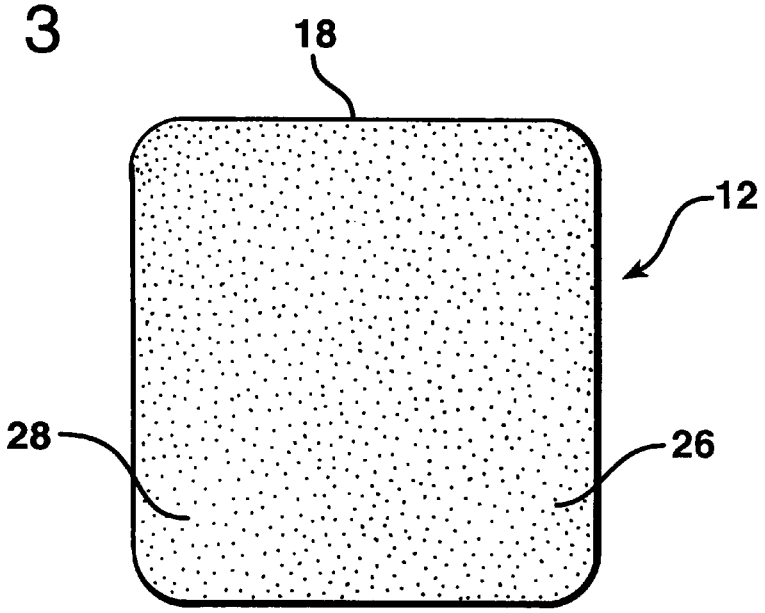
FIG. 3 shows a rear plan view of the decorative emblem.

A plan view of the rear of the decorative emblem 12 can be seen in FIG. 3. The substrate 18 includes a rear surface 26 which is coated with an adhesive material 28. The rear surface 26 of substrate 18 can be fully or partially coated with the adhesive material 28. The adhesive material 28 is provided on the rear surface 26 of the substrate 18 of decorative emblem 12 so that the decorative emblem 12 can be secured in recessed portion 17 of mount 16. Desirably, the adhesive material 28 will be of such a type that the decorative emblem 12 will be releasably secured in recessed portion 17 in mount 16. It is also desirable that the adhesive material 28 be a pressure sensitive adhesive. More desirably, the pressure sensitive adhesive will be a permanent pressure sensitive adhesive such as an acrylic based pressure sensitive adhesive. A useful pressure sensitive adhesive is available from the Flexcon Company, Inc. of Spencer, Mass. under the product designation Flexcon V402.

Suitable materials for the substrate 18 include polyester films and vinyl compounds. Useful polyester films include, but are not limited to, MYLAR® and LEXAN®. Useful vinyl compounds include, but are not limited to, vinyl chloride, vinyl acetate and similar esters, styrene, methyl methacrylate and acrylonitrile. Aluminum foils may also be used for the substrate 18. For the substrate 18, polyester films are preferred.

Suitable materials for the mount 16 include plastics, rubbers and metals. Virtually any type of material can be used for mount 16, because the adhesive material 28 can be selected and/or formulated so that it adheres the decorative emblem 12 to the mount 16. Desirably, the mount 16 is formed of a flexible material such as rubber or plastic so that when the mount 16 is attached to the promotional item 10, the promotional item 10 can be bent, folded or twisted and the mount 16 will not be damaged.

Another aspect of the present invention is directed to a method for making a promotional item, such as promotional item 10, having a removable decorative emblem, such as decorative emblem 12.

The decorative emblem 12 is formed by first printing a plurality of emblems 22 onto a sheet of the substrate 18 or a web of the substrate 18. The emblem 22 can be printed by any method currently used to print on materials such as those indicated for substrate 18. Useful printing methods include offset printing, simulated offset printing, flexographic printing, digital printing and silk screening. Desirably, the emblem 22 will be printed onto the substrate 18 by means of offset printing or simulated offset printing.

Once the emblems 22 have been printed on the substrate 18, the substrate 18 is coated on its front side 20 with the coating 24. Desirably, the coating 24 will be a durable material such as polyethylene, polyvinylchloride, and polyurethane. More desirably, the coating 24 will be a polyurethane coating. The polyurethane may be any relatively soft, flexible, weather-resistant polyurethane generally characterized by a Shore D hardness in the range of 35 to 65. One suitable polyurethane is the reaction product of (a) a mixture of polyester glycol and low to medium molecular weight polypropylenetriols and (b) an aliphatic diisocyanate-polypropylenetriol adduct. Useful materials and methods for making the decorative emblem 12 and/or coating the substrate 18 are disclosed in the following U.S. Pat. Nos.: 4,100,010 to Waugh entitled "Method for Making Decorative Emblems"; 4,292,827 to Waugh entitled "Method for Making Decorative Emblems"; and 4,356,617 to Coscia entitled "Decorative Emblems and Method for Making the Same." The disclosures of these patents are hereby incorporated by reference in their entireties.

After the emblems 22 have been coated with the coating 24, the rear surface 26 of substrate 18 is coated with the adhesive material 28. As stated above, the rear surface 26 can be partially or fully coated with the adhesive material 28. Useful coating methods include slot coating, roll coating, offset coating, spray coating and any other commonly used coating method. After the rear surface 26 of substrate 18 has been coated with adhesive material 28, the individual emblems 22 are cut from the substrate to form the individual decorative emblems 12. Typically, the individual decorative emblems 12 are cut by kiss cutting. The individual decorative emblems 12 may then be stored on a release liner (not shown) until they are ready to be adhered to the mounts 16.

As stated above, the mount 16 can be attached to the surface 14 of promotional item 10 by means of a hook and loop fastener, gluing, snaps, stitching or stapling. For example, a rear portion of the mount 16 may be provided with the hook portion of a hook and loop fastener, while the loop portion is attached to the surface 14 of the promotional item 10 thus providing a means for removably attaching the mount 16 to the promotional item 10. If mount 16 is made from a plastic or rubber material, it may be sewn directly to the surface 14 of the promotional item 10.

Figure 4:
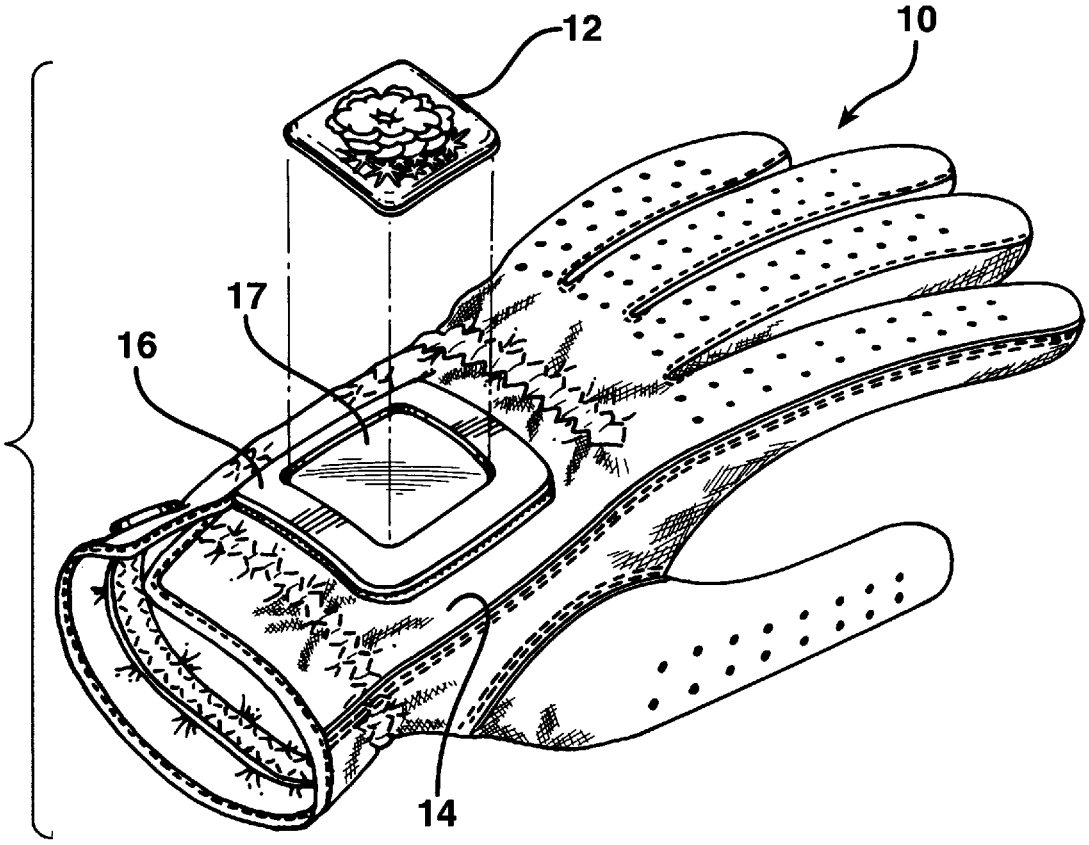
FIG. 4 shows an exploded view of a promotional item according to the present invention.

After the mount 16 has been attached to the surface 14 of the promotional item 10, the decorative emblem 12 is associated with the mount 16. As shown in FIG. 4, the rear surface 26 of substrate 18 bears the adhesive material 28. The decorative emblem 12 is positioned so that rear surface 26 of substrate 18 makes contact with the recessed portion 17 in mount 16. Desirably, pressure is applied to the decorative emblem 12 as it is being placed in mount 16 to ensure maximum adhesion by the adhesive material 28. Such pressure can be applied either by hand or by means of a press and can be applied for a variable period of time.

After the decorative emblem 12 has been adhered to the mount 16, the promotional item 10 may be set aside for a period of time to allow the adhesive material 28 to cure. The period of time for curing depends solely on the type of adhesive material 28 which is used and may last from several minutes to several days. For example, if Flexcon V402 is used as the adhesive material 28, the promotional item 10 should be set aside for about three days to ensure proper curing of the adhesive material 28.

In another version of the process of this invention, the decorative emblem 12 is adhered to the mount 16 before the mount 16 is attached to the promotional item 10. After the adhesive material 28 has cured, the mount 16 is then attached to surface 14 of promotional item 10. The remaining steps of the process proceed as described above. With this version of the process, it is much easier to store the mounts 16 and their associated decorative emblems 12 during the curing period than it is to store a large volume of promotional items 10 during the curing period. However, either order of assembly is equally effective.

Although the promotional item 10 has been depicted in the drawings as a golf glove 11, one skilled in the art will understand that the promotional item 10 may also be other clothing items such as a shirt, a hat, a jacket, pants, a belt or other gloves, such as baseball gloves or driving gloves.

Another advantage of the present invention is that the decorative emblems 12 can be removed from the mount 16. This allows one decorative emblem 12 to be replaced with a different or newer decorative emblem 12 without damaging the promotional item 10. Thus, one promotional item 10 could serve a variety of purposes.

The present embodiments are to be considered in all respects as illustrative and not restrictive. The scope of the invention is indicated by the appended claims rather than by the foregoing description, and there is no intention to exclude any equivalents thereof. Hence, various modifications are possible to the invention described herein without departing from the scope of the present invention as claimed.

What is claimed is:

1. A glove bearing a decorative emblem, said glove comprising:

a glove;

a mount having a recessed portion formed therein, said mount being attached to said glove; and a decorative emblem including an emblem printed on a substrate having a top surface and a rear surface, said decorative emblem being coated with a polymer coating on said top surface and coated with an adhesive on said rear surface, said polymer coating protecting said decorative emblem from water damage and scratching said decorative emblem being positioned in said recessed portion of said mount, whereby said glove bears a decorative emblem which is durable and capable of withstanding harsh weather conditions.

2. The promotional item of claim 1 wherein said substrate is selected from the group consisting of polyester films and vinyl compounds.

3. The glove of claim 1 wherein said polymer coating is a polyurethane which is a reaction product of a mixture of polyester glycol and a low to medium weight polypropylenetriol and an aliphatic diisocyanate-polypropylenetriol adduct.

4. The glove of claim 1 wherein said adhesive is a pressure sensitive adhesive and said decorative emblem is releasably secured to said mount thereby.

5. The promotional item of claim 4 wherein said pressure sensitive adhesive is an acrylic based adhesive.

6. The glove of claim 1 wherein said mount is removably attached to said glove.

7. The glove of claim 6 wherein said mount is removably attached to said glove by a hook and loop fastener or snaps.

* * * * *